United States Patent [19]

Ridley

[11] 3,951,456

[45] Apr. 20, 1976

[54] PROCESS FOR EFFECTING EVEN RETORT WORKING FLUID FLOW THROUGHOUT AN IN SITU RETORT CONTAINING CARBONACEOUS DEPOSITS

[75] Inventor: Richard D. Ridley, Claremont, Calif.

[73] Assignee: Occidental Petroleum Corporation, Los Angeles, Calif.

[22] Filed: Jan. 3, 1975

[21] Appl. No.: 538,461

Related U.S. Application Data

[63] Continuation of Ser. No. 385,319, Aug. 3, 1973, abandoned.

[52] U.S. Cl. ..... 299/2; 166/259; 208/11 R

[51] Int. Cl.[2] ..... E21B 43/26; E21C 41/10

[58] Field of Search ..... 299/2; 166/247, 259

[56] References Cited

UNITED STATES PATENTS

| | | | |
|---|---|---|---|
| 3,586,377 | 6/1971 | Ellington | 299/2 |
| 3,593,789 | 7/1971 | Prats | 166/247 |
| 3,661,423 | 5/1972 | Garret | 299/2 |

*Primary Examiner*—Ernest R. Purser
*Attorney, Agent, or Firm*—Christie, Parker & Hale

[57] ABSTRACT

The rubble pile in an in situ reactor, which has a low length-to-diameter ratio and limited retorting gas inlets and outlets, has a radial bulk permeability distribution controlled to provide retort working gas flow paths from the inlets to the outlets with substantially even overall flow resistance. Channeling of retort gas along paths of low resistance is therefore avoided. An example of the controlled radial distribution of bulk permeability is a cylindrical, vertical in situ retort having a retort gas inlet and outlet on its longitudinal axis. The bulk permeability of the rubble pile progressively increases from the center to the wall of the reactor. The rubble pile is created by undercutting a carbonaceous deposit and expanding, as by explosives, the unexcavated deposit overlying the undercut.

23 Claims, 5 Drawing Figures

Fig. 1
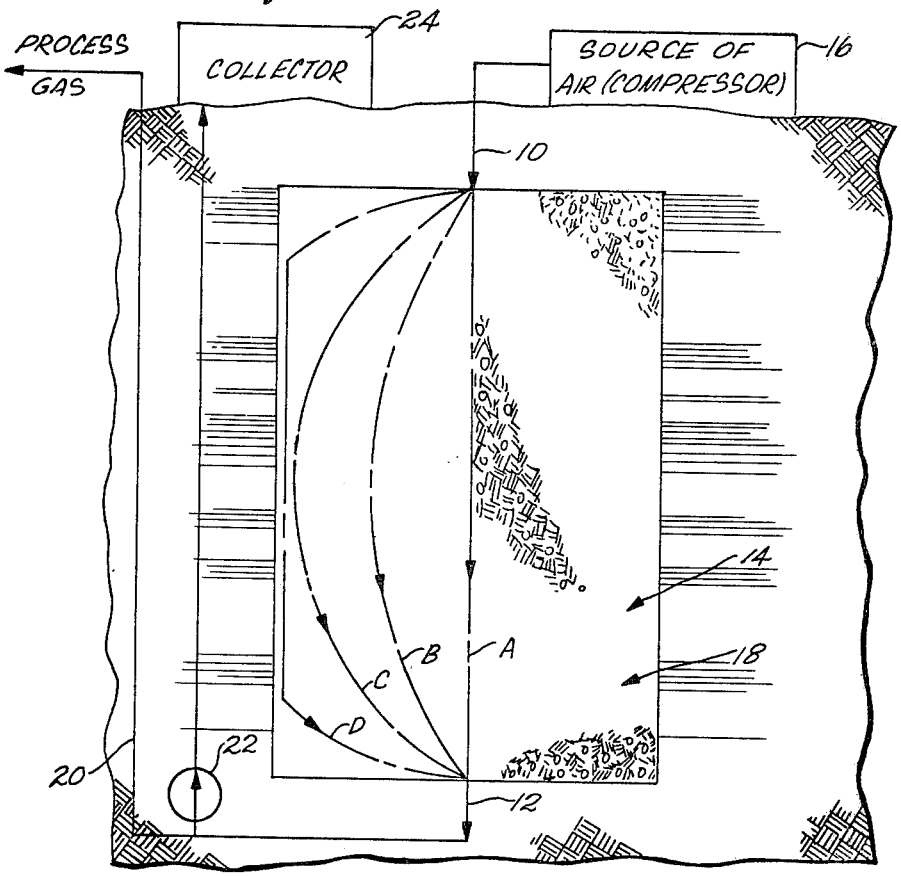
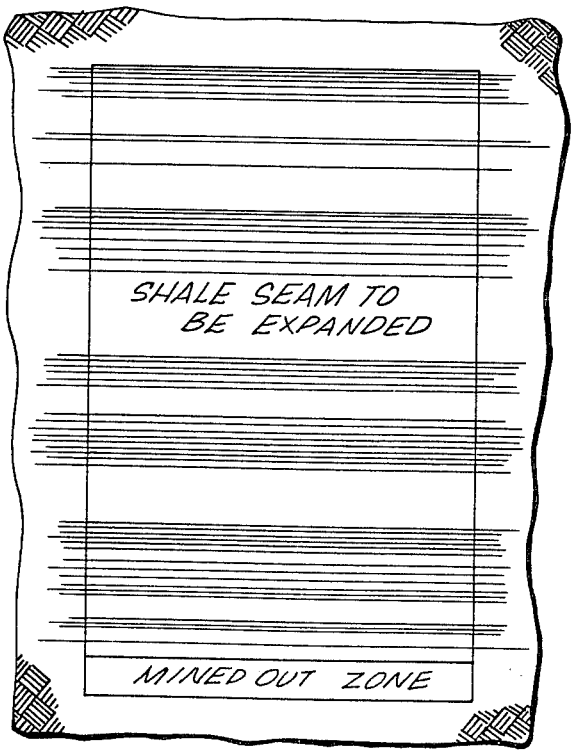
Fig. 2

PROCESS FOR EFFECTING EVEN RETORT WORKING FLUID FLOW THROUGHOUT AN IN SITU RETORT CONTAINING CARBONACEOUS DEPOSITS

CROSS REFERENCE TO RELATED APPLICATIONS

This is a continuation of application Ser. No. 385,319, filed Aug. 3, 1973, now abandoned.

BACKGROUND OF THE INVENTION

The present invention relates in general to in situ recovery by retorting organic carbonaceous values from carbonaceous deposits, as oil from oil shale, and, in particular, to a method for producing uniform retorting gas flow throughout a retort during the extraction of organic carbonaceous values.

There are vast untapped reserves of organic carbonaceous deposits which have not heretofore been exploited because it has not been economical to do so.

One type of unexploited organic carbonaceous deposit is oil shale. Vast reserves of oil bearing shale deposits exist throughout the world. One of the biggest of these deposits is in the Rocky Mountains of the United States.

The Piceance Creek Basin in Colorado is one reserve typical of many others. In the Piceance Creek Basin oil shale averaging 25 gallons per ton is found in seams varying from 50 feet vertical thickness to over 1,000 feet. However, in the areas where the oil shale is most accessible the seam thickness is invariably less than 150 feet, normally between about 100 to about 150 feet. It is in these accessible, relatively thin seam areas where commercial interest is presently being focused.

One of the most attractive methods of extracting oil from oil shale beds is by in situ retorting. In situ retorting envisions extracting the oil by heating it sufficiently to decompose kerogen, solid organic matter in the shale, into gas, oil and carbon. The oil values are collected from the in situ retort and processed further into saleable products.

The shale is fractured to produce a chimney of broken shale; i.e., a rubble pile, and is heated in place either by establishing a combustion zone in the bed or by using a retort fluid which is sufficiently hot to do the same job. In either event a retorting fluid is used. In the first case the retorting fluid, typically air, provides the oxygen necessary to support combustion in the combustion zone (thermal decomposition of residual carbon from the oil shale providing the fuel). In the second case the retorting fluid itself provides the heat energy required to retort the shale oil values. Combinations of these two types of retorting fluids and techniques have also been proposed.

The formation of a rubble-filled chimney is needed to provide passages for the retorting fluid, good heat transfer conditions to the shale, and paths for the retorted values. A broken-up bed of oil shale which is to be retorted is called a rubble pile.

An extreme method for developing a shale rubble pile is by a nuclear explosion. A nuclear explosion vaporizes some of the shale to create a void and the energy of the blast fractures the shale which will then collapse into the void. The collapsed shale occupies a larger volume than before the explosion and therefore passages are created for the retorting fluid. A nuclear created in situ retort has a length dimension running vertically which is much larger than the diameter. Typically, the length-to-diameter ratio (L/D) of a nuclear device created retort will be 2.2/1, and often greater. But nuclear created retorts must be used where there is a considerable amount of overburden or in very deep deposits to confine the effects of the nuclear blast in the ground. As such, the nuclear approach is of limited applicability even if nuclear devices were to become generally available.

A second method for developing an in situ retort and shale rubble pile envisions excavating or undercutting a large area at the base of the oil shale seam. The resulting exposed oil shale ceiling is allowed to collapse by itself.

Theoretically it is possible to mine out almost any thickness zone under the shale to create a rubble pile having almost any desired length-to-diameter ratio. But the most accessible and attractive areas are where the seams are relatively thin. In the accessible and attractive areas the undercutting technique has resulted in very low length-to-diameter ratios. One of the reasons for this is that a considerable area is necessary for free collapse of the ceiling over the excavated area. Moreover if the length is increased to obtain a high length-to-diameter ratio, it is increased only by caving low grade oil shale which is not economical to cave and retort. Consequently, retorting is horizontal when the rubble pile is developed by this method.

A third method for creating the rubble pile and an underground retort uses conventional explosives with or without natural roof failure and collapse. With natural roof collapse, the collapse is initiated by the removal of roof support pillars. After the roof fails, explosives are detonated in the remaining roof to cause further breakage and formation of the desired rubble pile. Since this method also requires free fall of a ceiling, it too requires a large cross-sectional area below the seam to produce free fall. The result, again, is a low length-to-diameter ratio. Therefore, this method also results in retorting in an essentially horizontal direction.

In the development of rubble piles it is extremely difficult to avoid voids, say, at the top of the rubble pile, where horizontally directed retorting fluids can short circuit. The result is poor retorting efficiency. Even if the broken shale "bulks full" and there is no void at the top of the retort, differences in bulk porosity at different retort heights are probable. With differences in bulk porosity in the vertical, most of the retorting fluids will pass through the zone having the greatest porosity because the resistance to flow is less. Again, poor retorting efficiencies are the result. Consequently, it is probable that very poor retorting efficiency is to be expected in horizontal in situ retorts.

Retorting in a vertical direction overcomes the difficulties in horizontal retorting because the retort gasses must pass through all vertical zones in any event and therefore will pass through any void zones.

While vertical retorting is attractive because it overcomes the problems with channeling of retorting fluids encountered in horizontal retorting, channeling is still possible in low length-to-diameter retorts. Channeling is possible because it is not always practical to provide enough retorting fluid inlets and outlets from the retort at the locations necessary to overcome the tendency of the retorting fluid to take the path of least resistance, typically the shortest path between inlet and outlet. In other words, with a limited number of retorting fluid inlets and outlets it is necessary for retorting fluids to traverse various length paths if the entire rubble pile in the retort is to be effectively contacted by the fluids. Because the techniques heretofore proposed for developing rubble piles and in situ retorts result in rubble piles which in any vertical zone have about the same bulk permeability for the retorting fluids, the problem of selective channeling exists even in vertical retorting.

Therefore, there is a need for developing rubble piles for in situ retorting of carbonaceous material, particularly in the vertical direction, which overcomes the problem of retorting fluid channeling.

SUMMARY OF THE INVENTION

The present invention provides a method for avoiding channeling of retorting fluids in in situ carbonaceous value retorting by selectively controlling the bulk permeability of a retort rubble pile to promote fluid flow throughout the entire retort. More particularly, the present invention provides a method for controlling the distribution of bulk permeability of a rubble pile in an in situ retort by progressively increasing the bulk permeability from the shortest to the longest path between a retorting fluid entrance and an exit.

A specific embodiment of the present invention contemplates developing an in situ rubble pile of the carbonaceous deposit to be retorted. Communication is established between the rubble pile and a source of retorting fluid. Communication is also estblished between the rubble pile and a carbonaceous value collector. The communication to the rubble pile for the collector is spaced by at least a portion of the rubble pile from the retorting fluid entrance into the pile. At an exit for the retorting fluid from the rubble pile, communication is established for the retorting fluid to a destination for the fluid. The radial distribution of the bulk permeability of the rubble pile is developed in such a manner that the resistance to retorting fluid flow through the rubble pile along retorting fluid paths through the pile is at least approximately equal along each path. The rubble pile thus developed is retorted to extract organic carbonaceous values with the retorting fluid, or at least with the aid of the retorting fluid. The retorted carbonaceous values are then collected in the collector.

The present invention is particularly suitable for recovering values from the kerogen in oil shale. In this context the present invention will be further summarized.

The retort is preferably vertical to avoid the problems attendant with horizontal retorting of channeling due to void development at the top of the retort and vertical bands of debris having different bulk permeabilities.

The problem of vertical channeling is particularly acute in in situ retorts having low length-to-diameter ratios and it is here, therefore, that the present invention finds its greatest application.

To take advantage of gravity and prevent retorted liquid values from entering a combustion zone in the retort, retorting is accomplished progressively from the top to the bottom of the retort.

The retorting fluid is typically air to provide oxygen for a combustion zone within the retort. Within the combustion zone shale oil value residuals, say, carbon, are burned to develop heat energy which retorts shale ahead of it in a retorting zone. The retorting fluid can also be superheated steam, recycled flue gas from the retort, or flue gas from an adjoining retort. The retorted values will collect at the bottom of the retort where they are transferred to the value collector as by a pump. Typically, the retorted values will be freed from the shale in both gas and liquid states. Vaporized values will condense on the cold rubble into droplets at the base of the retort. The liquid droplets will agglomerate there.

Communication between the source of the retorting fluid and the rubble pile and from the rubble pile to the destination of the retorting fluid is conveniently accomplished by conduits. These conduits enter the top of the retort for the entering retorting fluid and leave the base of the retort for the exiting retorting fluid. A conduit may also be provided between the base of the retort and the collector, which is typically located on the surface above the subterranean deposit being retorted.

The rubble pile is developed by undercutting. The deposit to be retorted is undercut to promote a condition where the remaining roof is susceptible to free collapse, explosively induced collapse, or both. However, because of the adjustment in the resulting pile's bulk permeability the easiest technique is through explosives. With the material removed from the undercut, the volume of the deposit to be retorted is free to expand into a larger volume constituted of its original volume and the volume of the undercut. The bulk permeability of the rubble pile may be controlled through explosive charge placement or by leaving a dome of rubble at the terminus of the shortest path between the retorting fluid entrance and exit. The size of the individual fragments of shale can also be controlled by the explosive charges and can be used to develop the desired bulk permeability variation. It is possible, of course, to use combinations of these. Typically, the floor of the undercut is contoured to provide collection drainage for the retorted values.

These and other features, aspects and advantages of the present invention will become more apparent from the following description, appended claims and drawings.

BRIEF DESCRIPTION OF THE DRAWINGS

FIG. 1 is a schematic depiction of an idealized retort shown in elevation;

FIG. 2 is a schematic depiction in elevation showing a technique for developing void volume;

DESCRIPTION OF THE PREFERRED EMBODIMENTS

Figure 3:
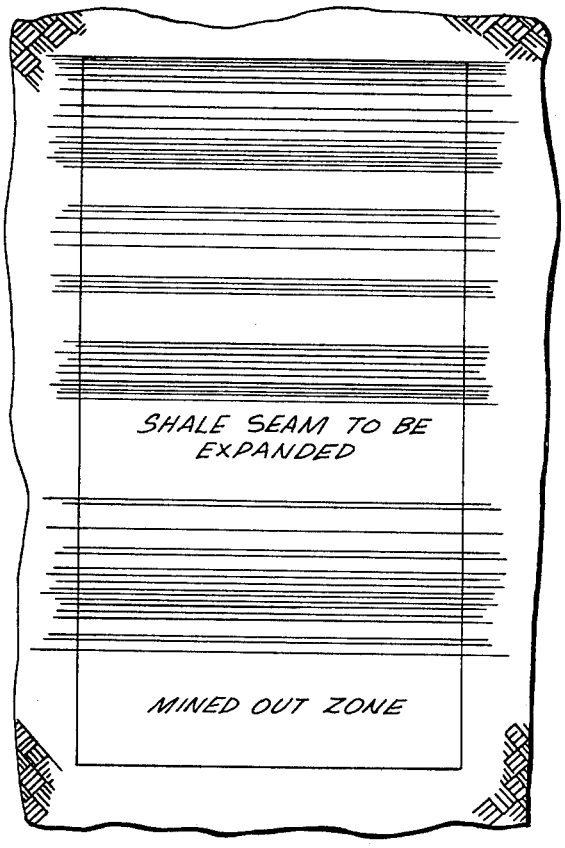
FIG. 3 is a view similar to FIG. 2 illustrating a technique for developing a larger void volume than shown there.

The detailed description of the present invention is directed to shale oil retorting and improving the gas flow and the efficiency of retorting of vertically oriented underground rubble piles having low length-to-diameter ratios.

FIG. 1 illustrates the problem for an idealized underground retort having a single inlet 10 and a single outlet 12, both located on the axis of a cylindrical in situ retort 14. Air from a compressor 16 is forced through inlet 10, through an expanded shale rubble pile 18, and out through outlet 12. The air and flue gasses from retort 14 are passed through a conduit 20 for recycling, removal of entrained values and the like. Retorted condensed and agglomerated liquid values are removed from outlet 12 by a pump 22 to a collector 24. Ideally, the air will spread out radially from inlet 10 and descend through retort 14 throughout the entire volume of the retort. The air and retort generated gasses will travel paths typified by paths A, B, C and D, as shown in FIG. 1. The four paths indicated show that as the gas moves out radially from the inlet port the overall path length increases. If pressure drop caused by the resisting shale per unit length of each path is equal, most of the gas flow will follow path A because it is the shortest path. However, because pressure drop is a function of velocity, as the velocity increases along axial path A the pressure drop will, as well, also increase and cause some diversion of gas away from the longitudinal axis of the retort. The net result is that most of the gas flow will be concentrated near the longitudinal axis with lower and lower flow rates obtaining as the radial distance from this axis increases. Pressur drop is also a function of the bulk porosity or permeability, usually expressed as percent void volume, of the broken shale bed. Within limits, it can be stated that the greater the void volume the lower the pressure drop. Without adjustment the bulk volume is essentially equal at any elevation in the retort. Consequently, without adjustment of the bulk volume, less than optimum air flow usually results even in vertical retorts. The problem of uneven air and flue gas passage through a vertical insitu retort increases as the horizontal zones served by a single inlet and outlet increase in area. In retorts which are long relative to their diameter the problem is not as acute because with increasing length the flow paths become parallel and are essentially equal to one another.

The purpose of this invention is to so alter the void volume or bulk permeability characteristics of the rubble pile, especially in low length-to-diameter ratio in situ retorts, that the total pressure drop for any path is the same length. Since path A through the center of the idealized retort of FIG. 1 is the shortest, the pressure drop per unit length along this path must be greater than elsewhere in the retort. The converse is true when considering path D in FIG. 1.

Rubble pile 18 is developed by undercutting the deposit to be retorted prior to the initiation of retorting and then allowing the ceiling of the resulting undercut to collapse by itself or with the aid of explosives. In either case the deposit to be retorted is expanded into a larger volume than it originally occupied. The roof can be supported by pillars which themselves are expanded by explosives during the creation of the rubble pile.

The void volume for the overall retort is determined by the amount of material removed in the undercut mining in relation to the amount of oil shale subsequently caved or expanded. If the total seam over the mined out area shown in FIG. 2 is caved, the resultant void volume would be, say, 6.25 percent while in FIG. 3 where more underlying rock has been removed, the void volume would be, say, 16.67 percent. In either event, if the seam is expanded evenly the void volume will be evenly distributed. If the shale at the bottom of the retort expands more than the top, the void volume will not be evenly distributed from top to bottom but still may have even radial distribution. With this constancy in void volume, uneven passage of retort gas and flue gas along different longitudinal paths will occur. By varying either or both the shape of the mined out zone or the shape of the zone being expanded to cause zones of different void volume to be created upon expansion of the bed, it is possible to develop uniform air and flue gas flow along the length of the retort and across the retort.

The bulk permeability of an oil shale rubble pile can be calculated from a formula appearing in D. B. Lombard, "The Particle Size Distribution and Bulk Permeability of Oil Shale Rubble," UCRL - 142.94 (1965).

$$K = \frac{3\,[7.7\ \mathrm{Exp}\,(\ln D_n + 5/2\,\sigma^2 \ln D]^2}{5\,(1-\phi)^2}$$

Where $k \equiv$ bulk permeability, ft$^2$ $\phi \equiv$ bulk porosity or void volume, %

$$\ln D_n \equiv \sum_i \frac{n_i}{N}(\ln D_i)$$

$$\sigma \ln D^2 \equiv \sum_i \frac{n_i}{N-1}(\ln D_i - \ln D_n)^2$$

$$N \equiv \sum_i n_i$$

$n_i \equiv$ the number of particles with the diameter $D_i$ $i \equiv$ the number of particles $\ln D_n \equiv$ arithmetic mean $\sigma \ln D^2 \equiv$ variance The solution of this equation for one particle size distribution typical of caved shale gives the following bulk permeability as a function of void volume:

| Void Volume ($\phi$) | Bulk Permeability (K) |
|---|---|
| 5 | $0.026 \times 10^{-4}$ |
| 10 | $0.2 \times 10^{-4}$ |
| 15 | $0.9 \times 10^{-4}$ |
| 20 | $2.4 \times 10^{-4}$ |
| 25 | $5.3 \times 10^{-4}$ |

As can be seen from the above table, void volume changes in the practical range for in situ retorting result in bulk permeability variations of over two orders of magnitude. This variation is related to pressure drop in packed beds by the following equation:

$$\Delta\sigma \equiv \frac{V_o\,\mu}{k} \pm \rho\, g$$

Where $V_o \equiv$ superficial velocity, ft./sec.

$\mu \equiv$ viscosity of the gas, No. sec./ft.$^2$ $k \equiv$ bulk permeability $\rho \equiv$ gas density $g \equiv$ acceleration due to gravity = 32.1740 ft./sec.$^2$ $\Delta\sigma \equiv$ pressure drop, psf/ft. retort length The second term is a gravity term and can be neglected since the retorting gas flow is returned to the starting elevation at the surface. The use of these two relationships will be more clearly shown in the following example.

EXAMPLE

A cylindrical underground rubble pile of oil shale is to be created with a 1.5 length-to-diameter ratio (L/D)

with the long axis being vertical and having a length of 150 ft. The room diameter is 100 ft. and the overall void volume is 15 percent. Retorting gas enters at the top center of the retort, as at entrance 10, and for purposes of this example is considered to exit at a single centrally located outlet as shown in FIG. 1 at 12. The gas then returns to the surface through an adjacent retort or the conduit shown in FIG. 1. The gas flowing through the retort will have a composition similar to air. The gas flow rate is 32 million SCF/day. At average temperature and pressure conditions in the retort, a superficial velocity of 0.0853 ft./sec. and a viscosity of $0.0334 \times 10^{-5}$ No. sec./ft.$^2$ results.

Path A in FIG. 1 represents the shortest path and is 150 ft. Path B is 1.1 times as long as path A, path C is 1.2 times as long, and path D is 1.4 times as long as path A. The approximate average path length is the path that equally divides the rubble pile in half. This is approximately 171 ft. and corresponds with an arc which passes through a point 35.5 ft. from the longitudinal axis of the retort (path A). The longest path is approximately 192 ft. The ratios of the average path length to the shortest and the longest paths are 1.14 and 0.89 respectively. By use of the relationship between permeability pressure drop, gas velocity and viscosity, k is calculated to be as follows:

| | |
|---|---|
| Shortest path: | $0.79 \times 10^{-4}$ |
| Average path: | $0.9 \times 10^{-4}$ |
| Longest path: | $1.01 \times 10^{-4}$ |

The void volumes corresponding to these bulk permeabilities are:

| | |
|---|---|
| Shortest path (longitudinal axis): | 14.4% |
| Average path (35.5 ft. radius): | 15.0 |
| Longest path (periphery): | 15.5 |

Figure 4:
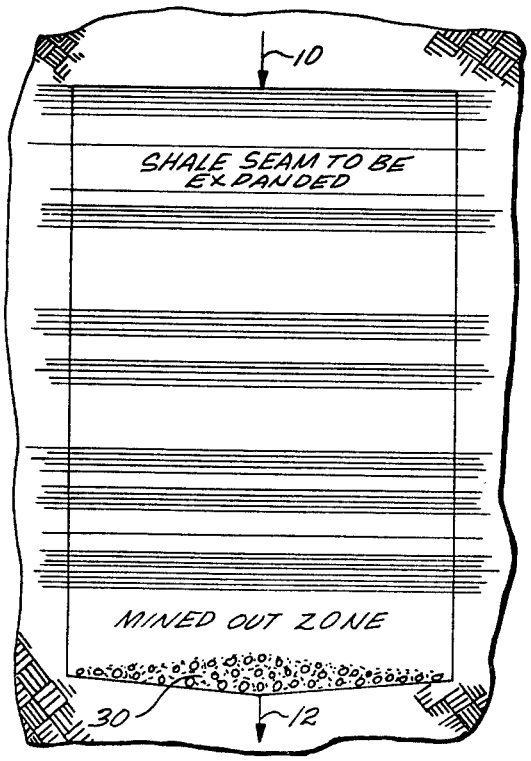
FIG. 4 is a depiction of an idealized retort in elevation illustrating one way of controlling bulk permeability.
Figure 5:
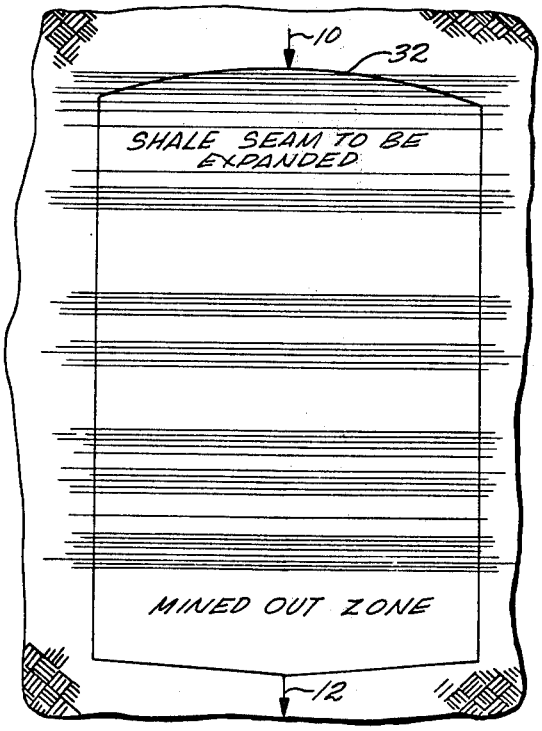
FIG. 5 is a depiction of an idealized retort in elevation illustrating a second way of controlling bulk permeability.

To achieve the void volume variations required for most efficient retorting, the shale must be more densely packed along the longitudinal axis of the retort in FIG. 1 than at its periphery. This can be accomplished by restricting the mined void volume (undercut) or by restricting the shape of the shale seam to be caved. The first approach necessitates a sloped floor of the undercut with the high point in the center. However, since this would restrict oil drainage to the outlet, the floor is sloped toward the center but some broken shale is left in the floor before caving to give the effect of a reverse slope on the void volume. This is shown in FIG. 4 at 30. FIG. 5 shows a slight doming of the ceiling at 32 (exaggeratd in the Figure for illustration) to cave less shale at the periphery than in the center.

Actual retorting will be described with reference to FIG. 1. As previously mentioned, retorting requires a retorting fluid and depending on the nature of the retorting process the retorting fluid may be a combination of air and flue gas, or steam and volatile gasses generated in the shale, flue gasses from adjoining retorts, recycled flue gas, and the like. In the example presented here, the retorting gas is air and flue gas is generated in the retort during the retorting process. Air is introduced from compressor 16 to the top of the retort through inlet 10. Typically at the initiation of the retorting process a startup fuel will be introduced with the air, though if flue gas is used as the retorting gas the starting fuel may not be necessary because of the temperature of the flue gas. In any event, after the startup fuel has been injected into the retort with the incoming air, it is ignited. Flue gas is generated from the resulting combustion front at the very top of the retort. When combustion becomes self-sustaining the startup fuel is discontinued. Retorting in a retorting front will proceed ahead of the combustion front, with the burning in the combustion zone providing the heat energy required for retorting. The two zones will descend through the retort more or less together. In the retorting zone heat from the combustion zone causes decomposition of kerogen in the oil shale to yield shale oil values which are carried down through the retorting bed with the moving retorting gasses and by gravity. Residual carbon left on the shale in the retorting zone becomes a fuel in the combustion zone and combines with oxygen to provide the heat for the retorting process. The retorted values collect at the base of the retort typically in liquid, vapor and gaseous states. Much of the gas and the vapor will condense on the cold material at the base of the retort and become liquid product. The liquid will agglomerate at the base. The resultant values are pumped through outlet 12 by pump 22 into collector 24. The retorting gas may be recycled, sent to a second retort to constitute at least a portion of that retort's retorting gas, itself processed to extract values or the like. The oxygen used in the retorting process is only enough to react with the residual carbon left on the retorted shale. Gas velocity during retorting is relatively low being in the neighborhood of from about 1 to about 4 SCF/min./ft.$^2$ retort cross-sectional area.

The present invention has been described with reference to a simplified retort. In actual practice the gas outlets will not normally be in the center but will consist of one or more peripheral outlets. Similarly, the inlet may consist of more than one entry and the retort shape may approach a square cross section instead of the circular cross section shown. Also, the retorts can be developed either with or without a void zone at the top of the broken shale. Nevertheless, the same basic concept of varying the void volume distribution or bulk permeability may be utilized to obtain even radial distribution of gas flow throughout the retort's length and throughout the width of the retort. Of course, each retort design will require its own peculiar void volume variations. Thus, a square retort with a single gas entry point and multiple peripheral exit ports would require a different distribution of the void volume than determined for the example given.

What is claimed is:

1. An in situ process for recovering carbonaceous values from a subterranean deposit comprising the steps of:

a. developing an in situ rubble pile within a retorting chamber of a subterranean carbonaceous deposit having a retorting fluid entrance and retorting fluid exit, said rubble pile being formed by undercutting at about the base of the carbonaceous deposit to remove a predetermined volume of material and form a sloped floor having a high point at the shortest retorting fluid path between the retorting fluid entrance and the floor and the low point at the periphery of the floor and expanding the deposit to form the in situ rubble pile wherein the bulk permeability of the rubble pile increases from the shortest retorting fluid path to the longest retorting fluid path between the retorting fluid entrance and the retorting fluid exit so that the resistance to retorting fluid flow through the rubble pile along all retorting fluid paths is approximately equal;

b. establishing the retorting fluid entrance between the rubble pile and a source of retorting fluid;

c. establishing the retorting fluid exit between the rubble pile and a destination for the retorting fluid, the exit communication with the rubble pile being spaced by at least a portion of the rubble pile from the retorting fluid entrance;

d. retorting the rubble pile to extract the carbonaceous values therefrom, the retorting step including the passage of the retorting fluid through the rubble pile along the retorting fluid paths; and e. recovering the retorted carbonaceous values.

2. The process claimed in claim 1 wherein the expansion step includes explosively expanding the subterranean deposit above the undercut.

3. The process claimed in claim 1 wherein the floor is formed from a permeable mass over the retorting fluid outlet.

4. The process claimed in claim 3 wherein the floor is prepared from the carbonaceous deposit formed in the undercutting operation.

5. An in situ process for recovering liquid and gaseous values from subterranean deposits comprising the steps of:

a. undercutting at least at the base of the subterranean carbonaceous deposit to remove a predetermined volume of material leaving a sloped floor having a high point below a selected retorting fluid entrance and a low point at the periphery of the floor;

b. expanding the carbonaceous deposit above the floor of the undercut to form a retorting chamber having a rubble pile wherein the bulk permeability of the rubble pile increases from the shortest retorting fluid path to the longest retorting fluid path between the retorting fluid entrance and a retorting fluid exit of said chamber such that the resistance to retorting fluid flow through the rubble pile along retorting fluid paths is approximately equal;

c. establishing the retorting fluid entrance communication between the upper level of the retorting chamber and a source of retorting fluid to provide an entrance for the retorting fluid;

d. establishing the retorting fluid exit communication between the base of the retorting chamber and a destination for the retorting fluid;

e. establishing outlet communication between the base of the retorting chamber and a liquid and gaseous value collector;

f. vertically downwardly retorting the rubble pile to extract the carbonaceous values therefrom by forcing the retorting fluid from its source through the paths from the retorting fluid entrance to its exit and to the retorting fluids destination while heating the rubble pile to decompose the contained carbonaceous materials to liquid and gaseous values and carbon; and g. collecting the liquid and gaseous values from the base of the deposit in the collector.

6. The in situ process claimed in claim 5 wherein the vertical height of the rubble pile relative to its width is low.

7. The in situ process claimed in claim 5 wherein the horizontal extent of the rubble pile served by the retorting fluid's entrances and exits is large.

8. The in situ process claimed in claim 5 wherein the expansion step includes explosively expanding the subterranean deposit above the undercut.

9. The in situ process claimed in claim 5 wherein the sloped floor is created from a permeable mass over the retorting fluid exit prior to developing the rubble pile.

10. The process claimed in claim 9 wherein the floor is formed from material developed during undercutting.

11. An in situ process for recovering carbonaceous values from a subterranean deposit which comprises the steps of:

a. undercutting at least the base of the subterranean carbonaceous deposit to remove a predetermined volume of material;

b. doming the ceiling of the deposit and forming a retorting chamber by caving the overlaying deposit into the undercut by caving less shale at the periphery of the deposit than at the center of the deposit to form a rubble pile having a bulk permeability which increases from the shortest retorting fluid path below a central retorting fluid entrance to the longest retorting fluid path between the retorting fluid entrance and a retorting fluid exit of said retorting chamber such that resistance to retorting fluid flow through the rubble pile along retorting fluid paths is approximately equal;

c. establishing retorting fluid entrance communication between the upper level of the retorting chamber and a source of retorting fluid to provide an entrance for the retorting fluid;

d. establishing retorting fluid exit communication between the base of the retorting chamber and a destination for the retorting fluid;

e. establishing outlet communication between the base of the retorting chamber and a liquid and gaseous value collector;

f. vertically downwardly retorting the rubble pile to extract the carbonaceous values therefrom by forcing the retorting fluid from its source through the paths from the retorting fluid entrance to its exit and to the retorting fluids destination while heating the rubble pile to decompose the contained carbonaceous materials to liquid and gaseous values and carbon; and g. collecting the liquid and gaseous values from the base of the deposit in the collector.

12. A process as claimed in claim 11 in which caving includes explosively expanding the subterranean deposit above the undercut.

13. An in situ process for recovering carbonaceous values from a subterranean deposit which comprises the steps of:

a. undercutting at least the base of the subterranean carbonaceous deposit to remove a predetermined volume of material;

b. expanding the carbonaceous deposit above the undercut to form a retorting chamber and doming the top of the rubble pile so that the bulk permeability of the rubble pile increases from the shortest retorting fluid path below a selected retorting fluid entrance to the longest retorting fluid path between the retorting fluid entrance and a retorting fluid exit of said retorting chamber such that the resistance to retorting fluid flow through the rubble pile along retorting fluid path is approximately equal;

c. establishing retorting fluid entrance communication between the upper level of the retorting chamber and a source of retorting fluid to provide an entrance for the retorting fluid;

d. establishing retorting fluid exit communication between the base of the retorting chamber and a destination for the retorting fluid;

e. establishing outlet communication between the base of the retorting chamber and a liquid and gaseous value collector;

f. vertically downwardly retorting the rubble pile to extract the carbonaceous values therefrom by forcing the retorting fluid from its source through the paths from the retorting fluid entrance to its exit and to the retorting fluids destination while heating the rubble pile to decompose the contained carbonaceous materials to liquid and gaseous values and carbon; and g. collecting the liquid and gaseous values from the base of the deposit in the collector.

14. A process as claimed in claim 13 in which expansion of the carbonaceous deposit is explosive.

15. A method of fragmenting a subterranean formation containing oil shale to form an in situ oil shale retort having fluid flow paths of differing lengths and differing bulk permeability from a fluid entrance at the top to the base of the in situ oil shale retort for equalizing flow rates of fluid along such paths, which comprises the steps of:

excavating a portion of the formation to form a void at the base of the in situ oil shale retort which is being formed; and caving oil shale from above the void into the void such that a smaller portion of the volume of the void is distributed through the oil shale in the shortest path from the fluid entrance to the base of the in situ oil shale retort than is distributed through oil shale in a longer path therebetween.

16. A method as recited in claim 15 wherein the height of the void is different in different portions of the void and the shortest height is at the position in the retort being formed where the distance from the fluid entrance to the base is the shortest.

17. A method as recited in claim 15 wherein the void has a floor sloping towards a fluid exit and further comprising the step of placing broken shale in the void, before caving, to different depths at different portions of the void such that the height of the void is different in different portions of the void and the shortest height of the void is at the position in the retort being formed where the distance from the fluid entrance to the base is the shortest.

18. A method of fragmenting a subterranean formation containing oil shale to form an in situ oil shale retort having fluid flow paths of differing lengths and differing bulk permeability from a fluid entrance at the top to the base of the in situ oil shale retort for equalizing flow rates of fluid along such paths, which comprises the steps of:

excavating a portion of the formation to form a void at the base of the in situ oil shale retort which is being formed; and caving a volume of oil shale from above the void towards the void for forming a rubble pile;

said void and said volume of oil shale being shaped in the excavating and caving steps for non-uniformly distributing void volume in the rubble pile so that the rubble pile of oil shale is more densely packed in the shortest path from the fluid entrance to the base of the in situ oil shale retort than in a longer path therebetween.

19. A method as recited in claim 18 wherein the height of the void is different in different portions of the void, and the shortest height is at the position in the retort being formed where the distance from the fluid entrance to the base is the shortest.

20. The method of claim 18 wherein the height of the oil shale to be caved is different in different portions of the retort and the greatest height is at the position in the retort being formed where the distance from the fluid entrance to the base is the shortest.

21. A method of fragmenting a subterranean formation containing oil shale to form an in situ oil shale retort having fluid flow paths of differing lengths and differing bulk permeability from a fluid entrance to a fluid exit for equalizing flow rates of fluid along such paths, which comprises the steps of:

excavating a portion of the formation to form a void at the base of the in situ oil shale retort which is being formed; and caving a volume of oil shale from above the void towards the void for forming a rubble pile;

shaping said void and said volume of oil shale in the excavating and caving steps for non-uniformly distributing void volume in the rubble pile so that the rubble pile of oil shale is more densely packed in the shortest path in the in situ oil shale retort from the fluid entrance to the fluid exit than in a longer path from the fluid entrance to the fluid exit.

22. A method as recited in claim 21 wherein the height of the void is different in different portions of the void, and the shortest height is at the position in the retort being formed where the distance from the fluid entrance to the fluid exit is the shortest.

23. The method of claim 21 wherein the fluid entrance is at the top and the fluid exit is at the base of the in situ oil shale retort and is vertically aligned with the fluid entrance and wherein the height of the oil shale to be caved is different in different portions of the retort and the greatest height is at the position in the retort being formed where the distance from the fluid entrance to the base is the shortest.

* * * * *

UNITED STATES PATENT AND TRADEMARK OFFICE

CERTIFICATE OF CORRECTION

PATENT NO. : 3,951,456
DATED : April 20, 1976
INVENTOR(S) : Richard D. Ridley

It is certified that error appears in the above-identified patent and that said Letters Patent are hereby corrected as shown below:

Column 5, line 21, "Pressur" should be -- Pressure --.

Column 6, line 14, "K" should be -- k --.

Column 6, line 14, "3" should be -- $\phi^3$ --.

Column 6, line 51, " $\sigma$ " should be -- $\rho$ --.

Column 6, line 59, " $\sigma$ " should be -- $\rho$ --.

Column 7, line 52, "exaggeratd" should be -- exaggerated --.

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*